US006161897A

United States Patent [19]

Kurtz et al.

[11] Patent Number: 6,161,897

[45] Date of Patent: Dec. 19, 2000

[54] CHAIR CONSTRUCTION

[75] Inventors: Eric J. Kurtz, Rock Island, Ill.; Ogden R. Olson, Muscatine, Iowa; Marcus C. Koepke, Carmel, Ind.; Earl H. Koepke, Pewaukee, Wis.

[73] Assignee: Hon Technology Inc., Muscatine, Iowa

[21] Appl. No.: 09/324,387

[22] Filed: Jun. 3, 1999

[51] Int. Cl.[7] ..... A47C 1/027; A47C 3/02

[52] U.S. Cl. ..... 297/321; 297/316; 297/320; 297/300.2; 297/300.4

[58] Field of Search ..... 297/321, 320, 297/316, 300.2, 300.4

[56] References Cited

U.S. PATENT DOCUMENTS

| | | | |
|---|---|---|---|
| 9,851 | 7/1853 | Bailey | 297/320 X |
| 326,241 | 9/1885 | Preston | 297/320 X |
| 942,818 | 12/1909 | Flindall | 297/320 X |
| 1,368,397 | 2/1921 | Hussander . | |
| 2,400,588 | 5/1946 | McArthur | 297/320 X |
| 2,454,912 | 11/1948 | Cunningham et al. | 297/320 |
| 2,760,556 | 8/1956 | Henrickson et al. | 297/321 |
| 3,146,028 | 8/1964 | Grosfillex . | |
| 3,393,941 | 7/1968 | Grosfillex . | |
| 4,305,617 | 12/1981 | Benoit . | |
| 4,744,600 | 5/1988 | Inoue . | |
| 4,789,203 | 12/1988 | Van Zee et al. | 297/316 X |
| 4,796,952 | 1/1989 | Piretti | 297/316 X |
| 4,943,115 | 7/1990 | Stucki | 297/300.4 |
| 5,540,481 | 7/1996 | Roossien et al. | 297/300.4 |
| 5,564,783 | 10/1996 | Elzenbeck et al. | 297/300.2 |
| 5,601,338 | 2/1997 | Wahls . | |
| 5,810,439 | 9/1998 | Roslund, Jr. | 297/300.2 X |

FOREIGN PATENT DOCUMENTS

| | | |
|---|---|---|
| 2110382 | 9/1971 | Germany . |
| 2551978 | 5/1976 | Germany . |

*Primary Examiner*—Peter M. Cuomo
*Assistant Examiner*—Rodney B. White
*Attorney, Agent, or Firm*—Jones, Day, Reavis & Pogue

[57] ABSTRACT

A chair has a seat supported on a base support assembly. The support assembly includes an upper bracket with a transverse tube mounted on the forward end thereof. The seat includes an upper shell having hooks extending downwardly from the underside thereof. The hooks are dimensioned and configured to engage the tube and provide for pivotable movement of the upper shell about the tube.

16 Claims, 2 Drawing Sheets

CHAIR CONSTRUCTION

BACKGROUND OF THE INVENTION

1. Field of the Invention

The present invention relates generally to the construction of a chair suitable for use in an office environment, and more particularly to a chair which is designed to have adjustable movement of the seat and back as the user changes position in the chair, and which is constructed in a highly novel and economic manner.

2. Description of the Related Art

Seating articles, such as chairs, often include mechanisms to provide position adjustment of various parts of the chairs. This is particularly true of chairs used in office environments where office workers are frequently seated over long periods of time. These adjustments can include, for example, modification of the chair seat relative to floor level, modification of chair back rest angle relative to an initial vertical position, and modification of chair seat angle relative to an initial horizontal position. All of these adjustments can contribute to the comfort of the chair user by selectively altering the user's body position when seated. Typically, these adjustments are accomplished by chair control mechanisms which include linkage systems of various types including spring biasing means.

A form of chair control system that has proved to be comfortable for the user is disclosed in early U.S. Pat. No. 2,083,838. This patent illustrates a body weight actuated chair wherein the rear of the seat raises slightly as the chair back tilts rearwardly. This allows the user to recline somewhat in the chair while his or her feet remain placed on the floor. The w eight of the user's body against the chair back acts through a slide mechanism to raise the seat back. While this construction allows for a degree of comfort to the user a disadvantage of the chair is that the slide mechanism is subject to wear and consequent binding over periods of use. Therefore, in practice it has a somewhat limited life and is lacking in reliability.

In more recent times a chair has been disclosed in U.S. Pat. No. 5,486,035 issued Jan. 23, 1996 to Koepke et al. wherein the chair has a reclinable back, and the seat and back are interconnected by a stiff resiliently flexible transition connection connecting the seat rear portion and the back lower portion. The seat front portion is pivotably mounted on a support whereby reclining of the back raises the seat rear portion producing an occupant weight operated reclinable chair having a substantially uniform back reclining force requirement throughout the reclining range of motion.

The Koepke et al. chair as just described offers considerable advantages over the chair disclosed in U.S. Pat. No. 2,083,838 essentially because it has very few moving parts which can be subject to wear. Basically, the chair is constructed with a support arm beneath the seat that has a seat front pivot and a rear pivot. These pivots are the only moving parts. Accordingly, the Koepke et al. chair can be readily constructed by known manufacturing methods and is highly reliable in use, although details of the chair construction are not specifically disclosed in the '035 patent.

In conventional office chair construction it is sometimes economical to manufacture the seat and back of the chair using molded plastic shells. In one such form of construction, the seat and back may each include two mating contoured shells, namely an upholstery shell and an outer shell. The upholstery shell in this construction is typically provided with suitable padding covered over by a layer of fabric or other similar upholstery material. The fabric layer, or the like, typically wraps over the peripheral edges of the shell and is fastened on the rear side of the shell. The outer shell which may or may not be similarly upholstered is then fastened to the back side of the upholstery shell thereby concealing the fastened edges of the fabric, lending an aesthetically pleasing finished appearance. A number of methods exist for fastening the shells together to create a finished chair. Such methods include the use of screws and snap fitting means cooperating between the two shells. However, the use of screws, for example, particularly if the screws are exposed to view is not as desirable aesthetically as a screwless appearance. Moreover, snap fitting means can make it difficult to take the chair apart once it is assembled, such as for reupholstering. Accordingly, it is desirable to construct a chair, particularly of the aforementioned type having a seat front pivot wherein the upholstery shell and outer shell are fitted together with a minimum of screw type fasteners. It is further desirable to provide such a chair wherein the upholstery shell and outer shell can be readily assembled and disassembled with a minimum of manual effort. Still further, it is desirable to provide such a chair wherein the connection means of the upholstery shell and outer shell can be readily manufactured in a cost-effective manner and is highly reliable in use.

SUMMARY OF THE INVENTION

The present invention improves over the prior art by providing a chair having a seat supported on a base support assembly. The support assembly includes an upper bracket with a transverse tube mounted on the forward end thereof The seat includes an upper shell having hooks extending downwardly from the underside thereof The hooks are dimensioned and configured to engage the tube and provide for pivotable movement of the upper shell about the tube.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
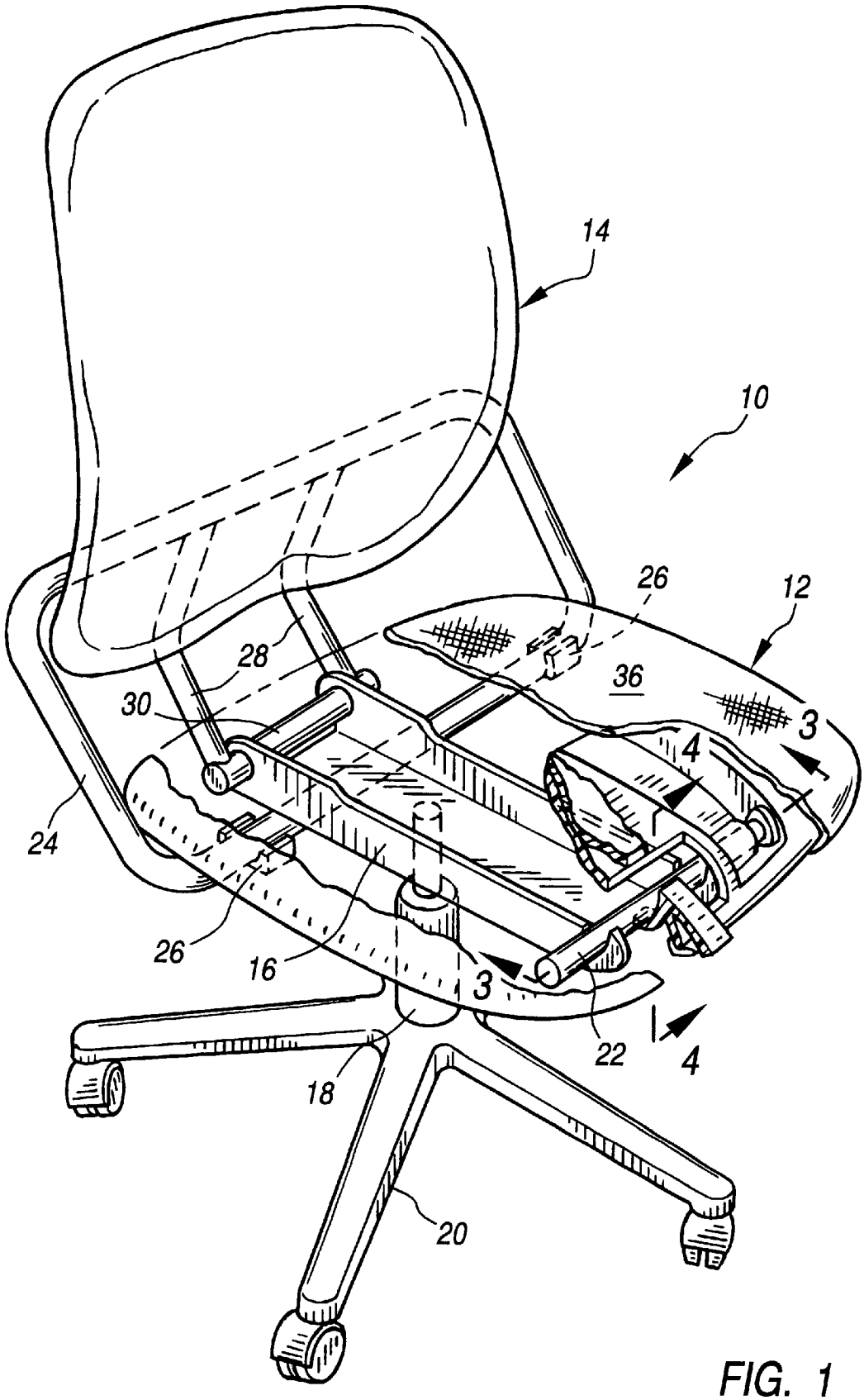
FIG. 1 is a perspective view partially broken away illustrating a chair of one type suitable for practicing the principles of the invention.

Referring now to the drawings, and initially to FIG. 1, a chair 10 is shown which is of a type that may employ a construction that practices the present invention. The illustrated chair 10 has a construction wherein a seat 12 and back 14 are interconnected in a manner such that as the back 14 reclines, the rear of the seat 12 raises slightly. To accomplish this coordinated movement of the seat 12 and back 14, an upper support member, or metal bracket 16, is mounted on a suitable pedestal 18 which may include an adjustable height air cylinder in turn supported on a base assembly 20. A transversely mounted tube 22 is fixed to the forward end of the bracket 16, as by welding, for example. In a manner which will be described in detail hereinafter, the tube 22 provides a forward pivot for the seat 12. A tube 24 is connected by bearing members 26 to the rear underside of the seat 28 thereby providing a rear seat pivot. The tube 24 is connected to the rear surface of the chair back 14 as well as to a pair of tubes 28 connected to a rear bracket pivot 30. The operation of the illustrated chair 10 is more fully set forth in co-pending application Ser. No. 09/325,933 filed Jun. 4, 1999 commonly assigned herewith, the disclosure of which is specifically incorporated herein by reference.

Figure 2:
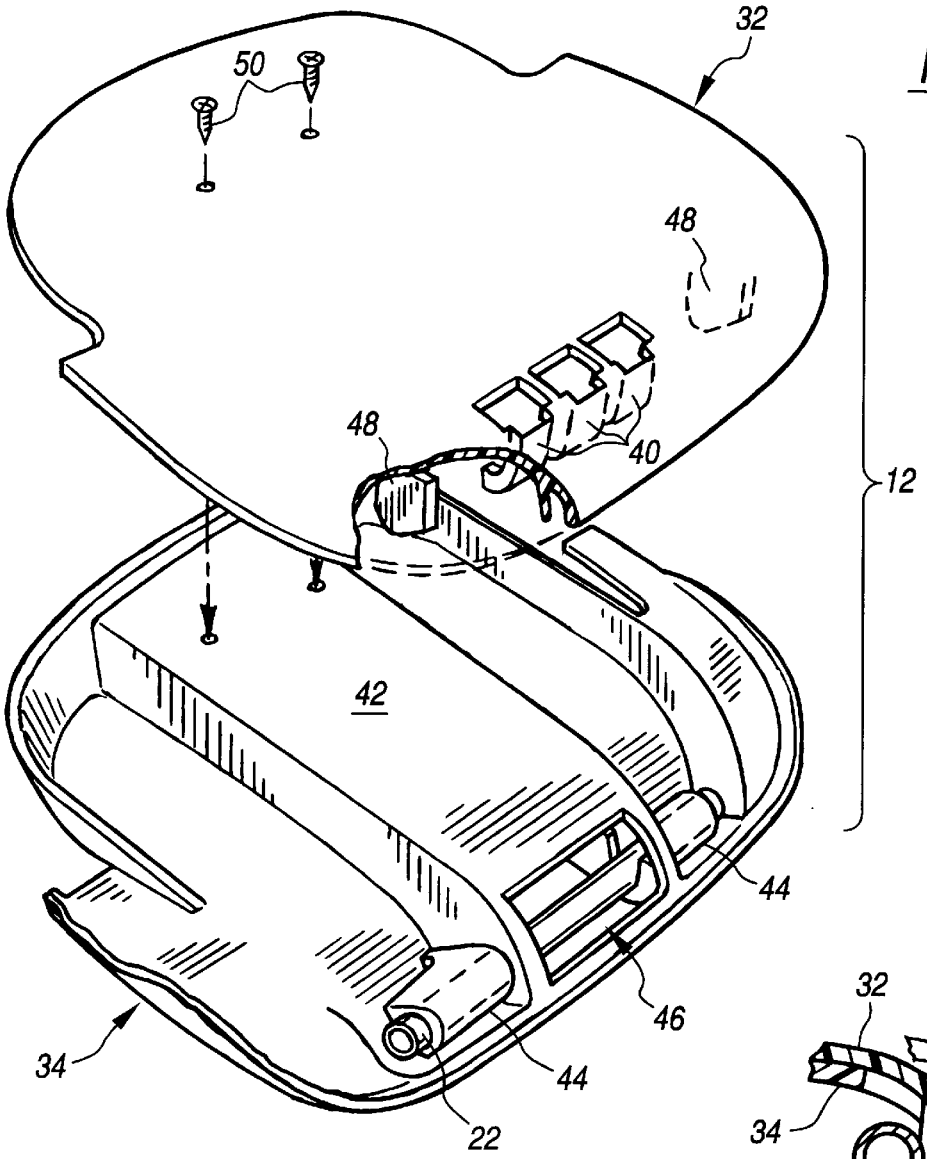
FIG. 2 is an exploded perspective view of a seat assembly suitable for use in the constriction of the chair of FIG. 1.

Turning now to FIG. 2 the seat 12 can be seen in greater detail as including an upper shell 32 and a lower shell 34. In a manner well known in the art, the shells 32, 34 are preferably molded from a suitable molded plastic material but they can also be wood. Upper shell 32 may serve as an upholstery shell having a fabric material 36 secured thereto as shown in FIG. 1. Lower shell 34 may serve as an outer exposed member to provide a finished appearance to the underside of the seat 12. In accordance with the invention, the upper shell 32 is formed with downwardly projecting hooks 40 which are preferably integrally molded from the bottom of the shell 32. The lower shell 34 is formed with a central raised portion 42 running from front to back of the shell 34 for purposes of allowing clearance between the bracket 16 and shell 34. Formed integrally with the raised portion 42 are a pair of laterally extending bearing portions 44 which are dimensioned and configured to receive and journal for rotation the transverse tube 22. An opening 46 is provided in the front of the portion 42 to receive the hooks 40 of the upper shell 32.

Figure 4:
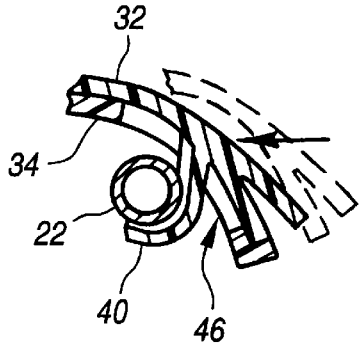
FIG. 4 is a partial cross-sectional view taken substantially along the line 4—4 of FIG. 2.
Figure 3:
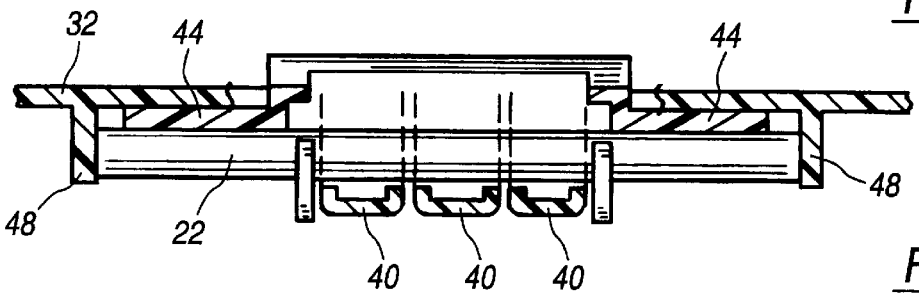
FIG. 3 is a partial cross-sectional view taken substantially along the line 3—3 of FIG. 2.

FIGS. 3 and 4 show in detail the cooperation of the forward portions of the shells 32, 34 when they are in assembled condition. The shells 32, 34 are arranged such that the hooks 40 pass through the opening 46 forwardly of the tube 22. The shells 32, 34 are then placed in abutting relationship and upper shell 32 is moved rearwardly of lower shell 34, as shown by the arrow in FIG. 4, until the hooks 40 engage the tube 22. The hooks 40 are so shaped that they wrap around the front side and bottom of the tube 22 and thereby provide a pivotable connection of the upper shell 32 to the tube 22 and prevent lateral movement thereof A pair of spaced tabs 48 that extend downwardly from the upper shell 32 and are integrally formed therewith abut respective ends of the tube 22 and thereby serve to center the upper shell 32 on the tube 22. The upper and lower shells 32, 34 may then be mutually aligned and secured together by suitable screws 50 (FIG. 2). Thus, the assembly of the upper and lower shells 32, 34 is secured to the tube 22 in centered relation and journalled thereon for limited rotation or pivoting.

It can now be appreciated that the chair construction as just described offers considerable advantages in providing for ease of assembly and functionality. With the engagement of the hooks 40 and tube 22, there is no need for additional fastening means attaching the forward portions of the shells 32, 34. The shells 32, 34 are secured together preferably by two simple screws 50. One screw may also be used. It can also be appreciated that many forms of chairs in addition to the illustrated chair 10 may practice the invention where the chair construction includes a seat front pivot. For example, the above-described Koepke et al. chair is another form of construction that may advantageously employ the present invention.

While the invention has been described in connection with a preferred embodiment thereof, it will be apparent to those skilled in the art that many changes and modifications may be made without departing from the true spirit and scope of the present invention. Accordingly, it is intended by the appended claims to cover all such changes and modifications as come within the spirit and scope of the invention.

What is claimed is:

1. A chair comprising:

a seat;

a support assembly for supporting said seat;

said support assembly including an upper support member having forward end;

a transverse tube member disposed proximate the forward end of said support member;

said seat including an upper shell; and hook means formed integrally as a one piece, unitary structure with and rigidly projecting downwardly from said upper shell;

said hook means being dimensioned and configured to engage said tube member and provide for pivotable movement of said upper shell about said tube member.

2. The chair of claim 1 wherein said hook means is integrally formed with said upper shell.

3. The chair of claim 1 including a lower shell dimensioned and configured to mate with said upper shell.

4. The chair of claim 3 wherein said lower shell includes bearing means for receiving said transverse tube member and providing a pivotable connection therewith.

5. The chair of claim 4 wherein said bearing means is integrally formed with said lower shell.

6. The chair of claim 3 wherein said lower shell includes an opening for receiving said hook means and allowing said hook means to engage said tube member.

7. The chair of claim 6 wherein said upper and lower shells jointly pivot about said tube when in an assembled condition.

8. The chair of claim 3 including fastening means for fastening said upper and lower shells together.

9. The chair of claim 8 wherein said fastening means is disposed at a rear portion of said shells.

10. The chair of claim 1 including tab means for engaging opposite ends of said tube member and centering said upper shell with respect to said tube member.

11. The chair of claim 10 wherein said tab means includes a pair of spaced tab members extending downwardly from an underside of said upper shell.

12. A chair comprising a seat;

a support assembly for supporting said seat;

said support assembly including an upper support member having a forward end;

a transverse tube member disposed proximate the forward end of said support member;

said seat including an upper shell and a lower shell, said shells being dimensioned and configured to mate together;

means provided on said upper shell to pivotably connect said upper shell to said transverse tube member; and means provided on said lower shell to pivotably connect said lower shell to said transverse tube member.

13. The chair of claim 12 wherein said means for pivotably connecting said upper shell includes at least one hook member.

14. The chair of claim 13 wherein said at least one hook member is integrally formed with said upper shell.

15. The chair of claim 12 wherein said means for pivotably connecting said lower shell includes bearing members.

16. The chair of claim 15 wherein said bearing members are integrally formed with said lower shell.

* * * * *